US007316541B2

(12) United States Patent
Baron

(10) Patent No.: US 7,316,541 B2
(45) Date of Patent: Jan. 8, 2008

(54) ENGINE-POWERED AIR COMPRESSOR WITH A CONTROLLER FOR LOW OIL CONDITION

(75) Inventor: Michael P Baron, Phoenix, MD (US)

(73) Assignee: Black & Decker Inc., Newark, DE (US)

( * ) Notice: Subject to any disclaimer, the term of this patent is extended or adjusted under 35 U.S.C. 154(b) by 299 days.

(21) Appl. No.: 10/922,286

(22) Filed: Aug. 19, 2004

(65) Prior Publication Data

US 2006/0039796 A1 Feb. 23, 2006

(51) Int. Cl.
*F04B 49/10* (2006.01)

(52) U.S. Cl. ..... 417/13; 417/228

(58) Field of Classification Search ..... 417/13, 417/228, 364; 123/198 DC, 198 D, 196 R, 123/198 C
See application file for complete search history.

(56) References Cited

U.S. PATENT DOCUMENTS

| | | | | |
|---|---|---|---|---|
| 1,579,241 | A | | 4/1926 | Papashvili |
| 3,196,389 | A | | 7/1965 | Heidner |
| 3,646,293 | A | | 2/1972 | Howard |
| 3,741,233 | A | | 6/1973 | Smith, Jr. |
| 3,846,747 | A | | 11/1974 | Arai et al. |
| 3,978,299 | A | | 8/1976 | Takai |
| 3,982,087 | A | | 9/1976 | Bachman |
| 4,037,193 | A | | 7/1977 | Uemura |
| 4,037,471 | A | | 7/1977 | Okamoto et al. |
| 4,056,979 | A | | 11/1977 | Bongort et al. |
| 4,064,755 | A | | 12/1977 | Bongort et al. |
| 4,130,382 | A | | 12/1978 | Bode |
| 4,142,079 | A | | 2/1979 | Bachman |
| 4,165,935 | A | | 8/1979 | Bongort et al. |
| 4,203,408 | A | | 5/1980 | Yamaguchi et al. |
| 4,259,975 | A | | 4/1981 | Kinsey, Jr. et al. |
| 4,383,802 | A | | 5/1983 | Gianni et al. |
| 4,395,605 | A | | 7/1983 | Weston |
| 4,496,286 | A | | 1/1985 | Gagnon |
| 4,497,205 | A | | 2/1985 | Zulauf et al. |
| 4,522,170 | A | * | 6/1985 | Lenk et al. ..... 123/198 DC |
| 4,539,547 | A | | 9/1985 | Nagy, Jr. et al. |
| 4,562,801 | A | | 1/1986 | Koike |
| 4,572,120 | A | | 2/1986 | Matsumoto |
| 4,584,977 | A | * | 4/1986 | Lenk et al. ..... 123/196 S |
| 4,622,935 | A | * | 11/1986 | Janisch ..... 123/198 DC |
| 4,627,283 | A | | 12/1986 | Nishida et al. |

(Continued)

FOREIGN PATENT DOCUMENTS

| | | | |
|---|---|---|---|
| JP | 403290074 | A | 12/1991 |

(Continued)

*Primary Examiner*—Anthony Stashick
*Assistant Examiner*—Vikansha Dwivedi
(74) *Attorney, Agent, or Firm*—Harness, Dickey & Pierce, P.L.C.

(57) ABSTRACT

An air compressor with an internal combustion engine having an engine oil sump, a compressor driven by the internal combustion engine and having a compressor oil sump, and a controller coupled to the internal combustion engine. The controller is configured to halt the operation of the internal combustion engine in response to either a low oil condition in the engine oil sump or a low oil condition in the compressor oil sump. A method for the operation of an air compressor is also provided.

6 Claims, 2 Drawing Sheets

U.S. PATENT DOCUMENTS

| | | | | |
|---|---|---|---|---|
| 4,684,917 | A | | 8/1987 | Tharman |
| 4,721,941 | A | | 1/1988 | Robine, Jr. et al. |
| RE32,593 | E | | 2/1988 | Matsumoto |
| 4,748,300 | A | | 5/1988 | Anderson |
| 4,787,343 | A | | 11/1988 | Tuckey |
| 4,805,066 | A | | 2/1989 | Mergenthaler |
| 4,876,529 | A | | 10/1989 | Kubota et al. |
| 4,888,576 | A | | 12/1989 | Kubota et al. |
| 4,924,703 | A | | 5/1990 | White et al. |
| 4,955,231 | A | | 9/1990 | Mahoney |
| 4,959,997 | A | | 10/1990 | Aisa et al. |
| 4,976,146 | A | | 12/1990 | Senghaas et al. |
| 4,995,357 | A | * | 2/1991 | Gonnering et al. ... 123/198 DC |
| 5,020,367 | A | | 6/1991 | White |
| 5,062,277 | A | | 11/1991 | Heitmann et al. |
| 5,254,815 | A | | 10/1993 | Nakano et al. |
| 5,273,134 | A | | 12/1993 | Hegemier et al. |
| 5,299,456 | A | | 4/1994 | Steiner |
| 5,301,643 | A | | 4/1994 | Garcyalny |
| 5,310,020 | A | | 5/1994 | Martin et al. |
| 5,327,997 | A | | 7/1994 | Nash, Jr. et al. |
| 5,493,086 | A | | 2/1996 | Murphy, Jr. et al. |
| 5,542,499 | A | | 8/1996 | Westermeyer |
| 5,634,345 | A | | 6/1997 | Alsenz |
| 5,765,995 | A | | 6/1998 | Springer |
| 5,829,303 | A | | 11/1998 | Fraser |
| 5,901,559 | A | | 5/1999 | Westermeyer et al. |
| 5,911,289 | A | | 6/1999 | Waller |
| 6,017,192 | A | | 1/2000 | Clack et al. |
| 6,040,767 | A | | 3/2000 | Dykstra |
| 6,068,447 | A | | 5/2000 | Foege |
| 6,125,642 | A | | 10/2000 | Seener et al. |
| 6,167,318 | A | | 12/2000 | Kizer et al. |
| 6,167,719 | B1 | | 1/2001 | Yakumaru et al. |
| 6,276,901 | B1 | | 8/2001 | Farr et al. |
| 6,302,654 | B1 | | 10/2001 | Millet et al. |
| 6,326,895 | B1 | | 12/2001 | Hartke et al. |
| 6,488,120 | B1 | | 12/2002 | Longsworth |
| 6,554,103 | B2 | | 4/2003 | Longsworth |
| 6,557,412 | B1 | | 5/2003 | Barbier et al. |
| 2002/0018724 | A1 | | 2/2002 | Millet et al. |

FOREIGN PATENT DOCUMENTS

| | | | |
|---|---|---|---|
| JP | 04039574 | A | 2/1992 |
| JP | 406033889 | A | 2/1994 |
| WO | PCT/AU95/00354 | | 12/1995 |

* cited by examiner

ENGINE-POWERED AIR COMPRESSOR WITH A CONTROLLER FOR LOW OIL CONDITION

The present invention generally relates air compressors and more particularly to an engine-powered air compressor with a controller that is responsive to oil levels in both the sump of the engine and the sump of the air compressor.

Given the increasing popularity of pneumatically-powered tools such as nailers and HVLP sprayers, larger air compressors, particularly those that are driven by an internal combustion engine, are becoming increasingly popular with modern consumers. One concern for such air compressors concerns the maintenance of both the internal combustion engine and the compressor, particularly in regards to the oils that are employed to lubricate and cool the interior components of the internal combustion engine and the compressor. More specifically, there is some concern that a portion of the users of such equipment will not regularly check oil levels in either the internal combustion engine or the compressor. In a worst-case-scenario, the extended operation of one or both of the internal combustion engine and the compressor may lead to reduced performance of the compressor and/or failure of the internal combustion engine or the compressor.

SUMMARY

In one form, the present teachings provide an air compressor with an internal combustion engine, a compressor and a controller. The internal combustion engine has an engine oil sump. The compressor is driven by the internal combustion engine and has a compressor oil sump. The controller is coupled to the internal combustion engine and halts the operation of the internal combustion engine in response to either a low oil condition in the engine oil sump or a low oil condition in the compressor oil sump.

In another form, the present teachings provide an air compressor with an internal combustion engine with an engine lubricant therein, a compressor driven by the internal combustion engine and having a compressor lubricant therein, and a controller coupled to the internal combustion engine. The controller is responsive to a quantity of engine lubricant in the internal combustion engine and to a quantity of compressor lubricant in the compressor and effecting a cessation of operation of the internal combustion engine if either a quantity of engine lubricant is less than or equal to a first threshold quantity or a quantity of compressor lubricant is less than or equal to a second threshold quantity.

In yet another form, the present invention provides a method comprising: providing an air compressor with an internal combustion engine and a compressor; operating the internal combustion engine to power the compressor; sensing a quantity of oil in the internal combustion engine; sensing a quantity of oil in the compressor; and halting operation of the internal combustion engine if either a quantity of oil in the internal combustion engine is less than or equal to a first threshold or a quantity of oil in the compressor is less than or equal to a second threshold.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

Additional advantages and features of the present invention will become apparent from the subsequent description and the appended claims, taken in conjunction with the accompanying drawings, wherein:

DETAILED DESCRIPTION OF THE VARIOUS EMBODIMENTS

Figure 1:
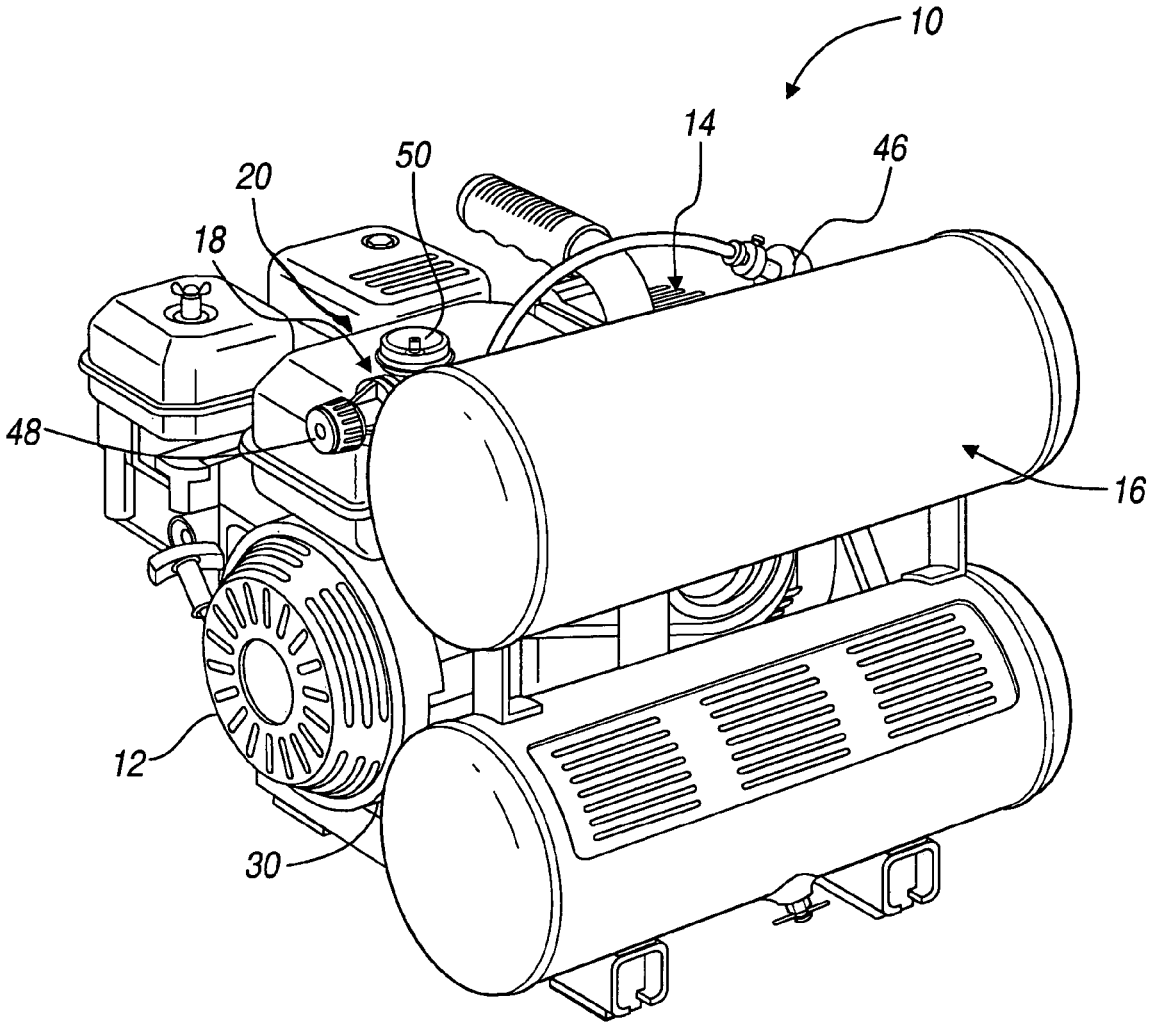
FIG. 1 is a perspective view of an air compressor constructed in accordance with the teachings of the present invention.
Figure 2:
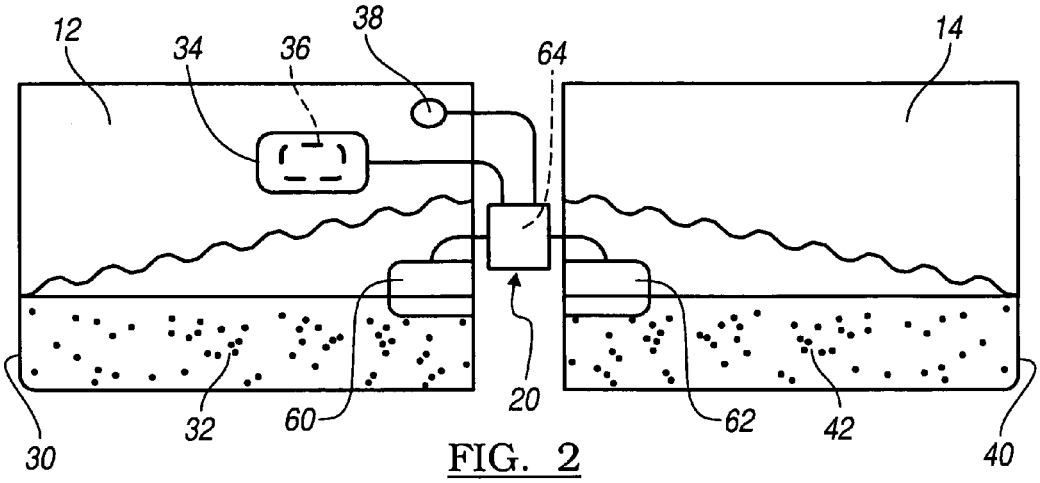
FIG. 2 is a schematic illustration of a portion of the air compressor of FIG. 1.

With reference to FIGS. 1 and 2 of the drawings, an air compressor constructed in accordance with the teachings of the present invention is generally indicated by reference numeral 10. The air compressor 10 may generally include an internal combustion engine 12, a compressor 14, a storage tank 16, a pneumatic control unit 18 and a controller 20. Except as otherwise provided herein, the internal combustion engine 12, compressor 14, storage tank 16 and pneumatic control unit 18 are conventional in their construction and operation and as such, a detailed discussion of these components is not needed.

Briefly, the internal combustion engine 12 converts a fuel, such as gasoline, into rotary power that is employed to drive the compressor 14. The internal combustion engine 12 includes an engine oil sump 30, which is operable for holding a quantity of engine oil 32 that is employed to lubricate and cool the various internal components of the internal combustion engine 12, and an ignition circuit 34. The ignition circuit 34 controls the operation of the internal combustion engine 12 and in the example provided, includes a magneto 36. The magneto 36 is operable for generating electrical power that is employed by a spark plug (not specifically shown) to initiate a combustion event in a cylinder (not specifically shown) to converts the fuel into gases and drive a piston (not shown) through a power stroke. Coupling of the magneto 36 to a ground terminal 38 may be employed to inhibit the operation of the spark plug to thereby halt the operation of the internal combustion engine 12.

Power transmitted from the internal combustion engine 12 to the compressor 14 drives elements within the compressor 14, such as one or more pistons, to compress air. Like the internal combustion engine 12, the compressor 14 includes a compressor oil sump 40 that is operable for holding a quantity of compressor oil 42 that is employed to lubricate and cool the various internal components of the compressor 14.

The compressed (i.e., pressurized) air produced by the compressor 14 is transmitted to the storage tank 16 for storage until it is released by the pneumatic control unit 18. The pneumatic control unit 18 may include pressure taps 46, which permit a user to couple an air hose (not shown) to the compressor 14 to draw compressed air from the storage tank 16 as needed, one or more regulators 48, which permit a user to regulate the pressure of the air that is being released from the storage tank 16, and optionally one or more pressure gauges 50, which permit the user to monitor the pressure in the storage tank 16 and/or the pressure of the air that is delivered from the storage tank 16.

The controller 20 is operable for identifying a low oil condition in both the internal combustion engine 12 and the compressor 14 and halting or stopping the operation of the internal combustion engine 12 if a low oil condition occurs in either the internal combustion engine 12 or the compressor 14. The controller 20 may include a first sensor 60, a second sensor 62 and an optional circuit latch 64.

Figure 3:
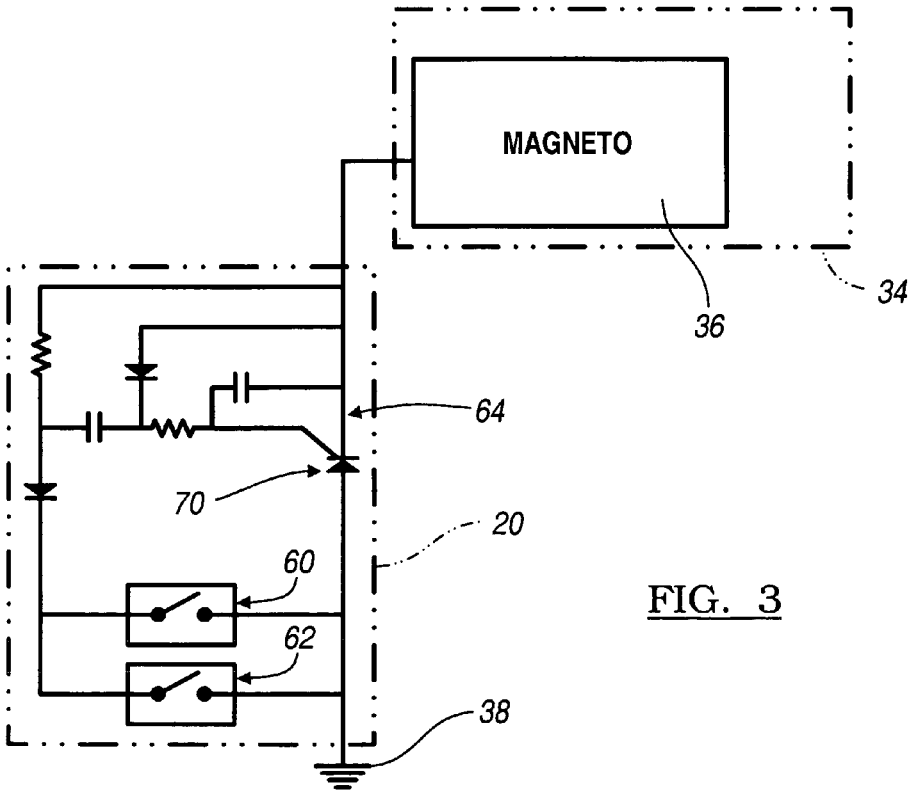
FIG. 3 is an schematic illustration of a portion of the air compressor of FIG. 1 illustrating the controller and the ignition circuit in greater detail.

With additional reference to FIG. 3, the first sensor 60 is operable for monitoring a quantity of engine oil 32 in the internal combustion engine 12 and generating a low engine oil signal when the quantity of engine oil 32 is less than or equal to a first threshold. Similarly, the second sensor 62 is operable for monitoring a quantity of compressor oil 42 in the compressor 14 and generating a low compressor oil signal when the quantity of compressor oil 42 is less than or equal to a second threshold. The first and second sensors 60 and 62 may be any appropriate type of sensor and need not be of the same type. For example, the first and/or second sensors 60 and 62 may be a float-type switch, such as a reed-type switch that is actuated by a magnetic float (e.g., a LS1900 float sensor by GEMS Sensors of Plainville, Conn.), or a capacitive liquid level switch (e.g., a S46 switch marketed by e-Components International, Inc. of Lancaster, Va.). In the particular example provided, both the first and second sensors 60 and 62 are float-type switches with a normally open reed-type switch that is activated by a magnetic float.

In its most basic form, the first and second sensors 60 and 62 may selectively couple the ignition circuit 34 of the internal combustion engine 12 the internal combustion engine 12 if a low oil condition is detected in either the engine oil sump 30 or the compressor oil sump 40.

The optional circuit latch 64 may be employed to ensure that the operation of the internal combustion engine 12 will be cleanly and quickly terminated in response to the detection of a low oil condition in either the internal combustion engine 12 or the compressor 14. More specifically, the circuit latch 64 is operable for sensing the grounding of the ignition circuit 34 to the ground terminal 38 and responsively coupling the ignition circuit 34 to the ground terminal 38 until reset by the occurrence of a predetermined event. In the particular example provided, the circuit latch 64 includes a thyristor 70 that selectively couples the ignition circuit 34 to the ground terminal 38 and "resets" (i.e., uncouples the ignition circuit 34 from the ground terminal 38) in response to the powering down of the ignition circuit 34 (which occurs when the operation of the internal combustion engine 12 has halted and the magneto 36 is not producing electrical energy).

While the invention has been described in the specification and illustrated in the drawings with reference to various embodiments, it will be understood by those skilled in the art that various changes may be made and equivalents may be substituted for elements thereof without departing from the scope of the invention as defined in the claims. Furthermore, the mixing and matching of features, elements and/or functions between various embodiments is expressly contemplated herein so that one of ordinary skill in the art would appreciate from this disclosure that features, elements and/or functions of one embodiment may be incorporated into another embodiment as appropriate, unless described otherwise, above. Moreover, many modifications may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but that the invention will include any embodiments falling within the foregoing description and the appended claims.

What is claimed is:

1. An air compressor system comprising:

an internal combustion engine having an engine oil sump and an ignition circuit that outputs electrical energy to initiate a combustion event;

an air compressor driven by the internal combustion engine, the air compressor having a compressor oil sump;

a single control circuit comprising a thrysistor having a first terminal, which is coupled to the ignition circuit, and a second terminal that is coupled an electrical ground;

a first sensor for sensing a level of a first lubricant in the engine oil sump, the first sensor generating a first sensor signal when the level of the first lubricant in the engine oil sump is less than a predetermined first threshold; and a second sensor for sensing a level of a second lubricant in the compressor oil sump, the second sensor generating a second sensor signal when the level of the second lubricant in the compressor oil sump is less than a predetermined second threshold;

wherein the first and second sensors are coupled in parallel between the ignition circuit and the electrical ground.

2. The air compressor system of claim 1, wherein the first sensor is a switch.

3. The air compressor system of claim 2, wherein the switch is a float switch.

4. The air compressor system of claim 1, wherein the second sensor is a switch.

5. The air compressor system of claim 4, wherein the switch is a float switch.

6. An air compressor system comprising:

an internal combustion engine with an engine lubricant therein;

an air compressor driven by the internal combustion engine, the air compressor having a compressor lubricant therein;

a single control circuit coupled to the internal combustion engine, the control circuit having an input leg, which that is electrically coupled to the ignition circuit, and an output leg, which is electrically coupled to an electrical ground;

a first sensor electrically coupled to the input leg and the output leg, the first sensor being operable for sensing a level of a first lubricant in the engine oil sump, the first sensor generating a first sensor signal when the level of the first lubricant in the engine oil sump is less than a predetermined first threshold; and a second sensor electrically coupled to the input leg and the output leg, the second sensor being operable for sensing a level of a second lubricant in the compressor oil sump, the second sensor generating a second sensor signal when the level of the second lubricant in the compressor oil sump is less than a predetermined second threshold.

* * * * *